US005570846A

United States Patent [19]

Stehr

[11] Patent Number: 5,570,846

[45] Date of Patent: Nov. 5, 1996

[54] METHOD AND APPARATUS FOR THE CONTINUOUS AUTOGENOUS GRINDING OF FREE-FLOWING STOCK

[75] Inventor: Norbert Stehr, Grünstadt, Germany

[73] Assignee: EVV-Vermogensverwaltungs-GmbH, Wiesloch, Germany

[21] Appl. No.: 524,639

[22] Filed: Sep. 7, 1995

[51] Int. Cl.[6] ..... B02C 17/16

[52] U.S. Cl. ..... 241/21; 241/29; 241/171; 241/172

[58] Field of Search ..... 241/21, 29, 171, 241/172, 173, 174

[56] References Cited

U.S. PATENT DOCUMENTS

| | | | |
|---|---|---|---|
| 3,311,310 | 3/1967 | Engels et al. | 241/171 |
| 3,844,490 | 10/1974 | Schold et al. | 241/74 |
| 4,206,879 | 6/1980 | Geiger | 241/46.11 |
| 4,754,934 | 7/1988 | Ikebuchi et al. | 241/69 |
| 4,848,676 | 7/1989 | Stehr | 241/33 |

FOREIGN PATENT DOCUMENTS

| | | |
|---|---|---|
| 0219740B1 | 4/1987 | European Pat. Off. . |
| 0247895 | 12/1987 | European Pat. Off. . |
| 0367403 | 5/1990 | European Pat. Off. . |
| 1056257 | 6/1964 | United Kingdom . |

*Primary Examiner*—John M. Husar
*Attorney, Agent, or Firm*—Browdy and Neimark

[57] ABSTRACT

For the continuous autogenous grinding of a free-flowing stock containing insoluble particles of varying diameter, the stock is set rotating concentrically of an axis in a grinding chamber, insoluble particles of greater diameter being concentrated superproportionally in the grinding chamber. There is no need of an auxiliary-grinding-body retaining device.

25 Claims, 7 Drawing Sheets

METHOD AND APPARATUS FOR THE CONTINUOUS AUTOGENOUS GRINDING OF FREE-FLOWING STOCK

BACKGROUND OF THE INVENTION

1. Field of the Invention

The invention relates to a method for the continuous autogenous grinding of free-flowing stock containing insoluble particles of varying diameter and an apparatus for putting the method into practice.

2. Background Art

The grinding of especially hard substances such as silicates and carbides is complicated. Agitator mills are known to be used that comprise a cylindrical receptacle, in which a high-speed agitator unit is disposed concentrically. The grinding receptacle is at least substantially filled with auxiliary grinding bodies. The grinding stock is supplied to one end of the receptacle in a free-flowing condition - it may for instance be made into a paste with the addition of water - and it is discharged from the receptacle at the other end. The mix of grinding stock and auxiliary grinding bodies is intensively moved by the agitator unit so that intensive milling takes place. In the vicinity of the grinding-stock outlet, provision must be made for an auxiliary-grinding-body retaining device, by means of which the auxiliary grinding bodies can be separated from the stock for the latter to be discharged free from auxiliary grinding bodies. When extremely hard particles are milled, the wear of the auxiliary grinding bodies is high. As for the milling of lowgrade grinding stock as bulk goods, the cost of the wear of auxiliary grinding bodies is not reasonable as compared with the value of the grinding stock, even though the wear of auxiliary grinding bodies is not overly high. Moreover, there is quite a risk that the auxiliary-grinding-body retaining device is clogged by particles of grinding stock that are still too large and/or by worn auxiliary grinding bodies, which may lead to breakdowns or even to the partial destruction of the agitator mill. This risk increases when high throughputs of stock are run, which is accompanied by correspondingly high flow rates of the stock in the agitator mill. EP 0 219 740 B1 teaches an annular-gap-type ball mill for continuously pulverizing in particular hard mineral substances, comprising a closed grinding container housing a rotor, whose outer surface cooperates with the inner surface of the grinding container to define a grinding gap. The grinding gap contains so-called grinding pellets, i.e. auxiliary grinding bodies. The top portion and the lower portion of the rotor taper in opposite directions. As a result of the double-conical design of the grinding gap, any discharge of the auxiliary grinding bodies along with the stock through an outlet, and thus any reduction of the quantity of auxiliary grinding bodies or of the grinding effect is precluded. This is due to the fact that a given excess quantity of auxiliary grinding bodies collects in the radial annular chamber at the upper end of the grinding gap, i.e. where the diameter of the rotor has its maximum, there forming a floating blocking layer that will retain the active auxiliary grinding bodies in the grinding gap without affecting, in the way of a screen or the like, the discharge of the pulverized stock from the grinding gap in the direction of the outlet. There is no need of any subsequent separation of auxiliary grinding bodies and grinding stock. However, this is only true for low throughputs, i.e. at a low flow rate of the milled stock in the grinding gap. In the case of high throughputs and correspondingly higher flow rates of the stock in the grinding gap, the auxiliary grinding bodies will be discharged too, again necessitating the subsequent separation of auxiliary grinding bodies and stock. Of course, the above-mentioned problems of wear of the auxiliary grinding bodies continue to exist.

SUMMARY OF THE INVENTION

It is the object of the invention to create a method and an apparatus of the type mentioned at the outset, which ensure continuous autogenous grinding of stock in a particular simple way even with high throughputs and without breakdowns.

In a method of the type mentioned at the outset, this object is attained in that the stock is set rotating concentrically of an axis in a grinding chamber, and in that insoluble particles of greater diameter are concentrated in the grinding chamber superproportionally as compared to particles of smaller diameter. This method is put into practice by an apparatus comprising a grinding receptacle enclosing a grinding chamber free from auxiliary grinding bodies, an agitator unit disposed in the grinding receptacle concentrically of the latter's axis, agitator elements attached to the agitator unit, a drive motor coupled with the agitator unit, at least one stock supply connector opening into the grinding chamber, and at least one outlet for treated stock disposed in the vicinity of the axis and not comprising an auxiliary-grinding-body retaining device. The gist of the invention resides in that the particles of greater diameter are concentrated in the grinding chamber, where they serve as auxiliary grinding bodies for grinding the particles of smaller diameter, while themselves being subject to abrasion on their outer surface. No individual alien auxiliary grinding bodies are used; farther, no auxiliary-grindingbody retaining device is needed, because the particles used, as it were, as auxiliary grinding bodies stay in the grinding chamber. Breakdowns owing to the clogging of the auxiliary-grinding-body retaining device will not occur any more. The grinding stock is classified, namely into particles of greater diameter used for grinding and into particles of smaller diameter that are to be ground. The particles of greater diameter are supplied to the grinding chamber of the agitator mill where they stay. Subsequently, for the purpose of grinding, only the stock preliminarily classified with particles of smaller diameter is guided through the grinding chamber.

Further features, advantages and details of the invention will become apparent from the ensuing description of five exemplary embodiments, taken in conjunction with the drawing.

DESCRIPTION OF THE PREFERRED EMBODIMENTS

Figure 1:
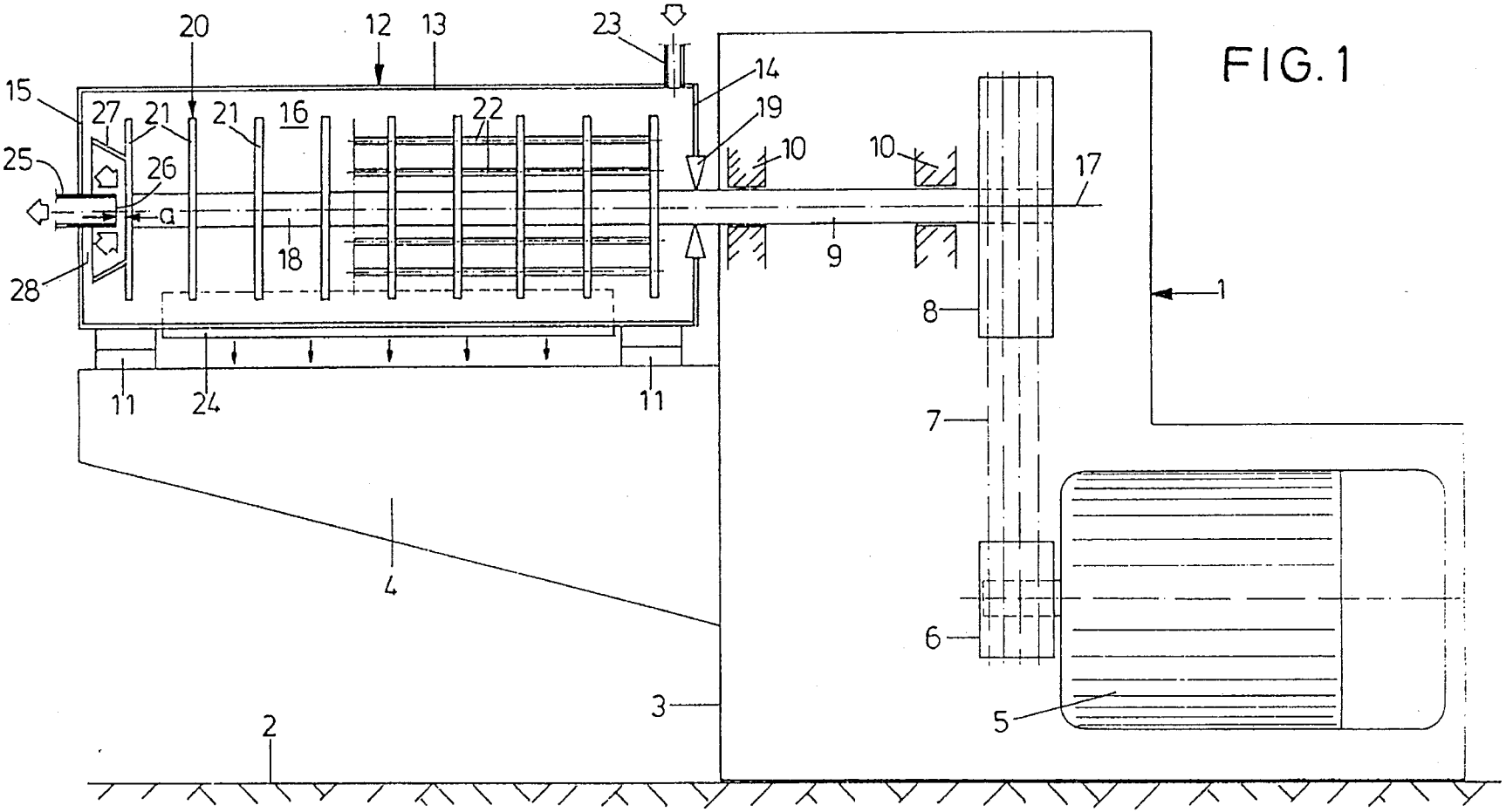
FIG. 1 is a diagrammatic illustration of a vertical section of a first embodiment of an autogenous-grinding apparatus composed in the way of an agitator mill.
Figure 2:
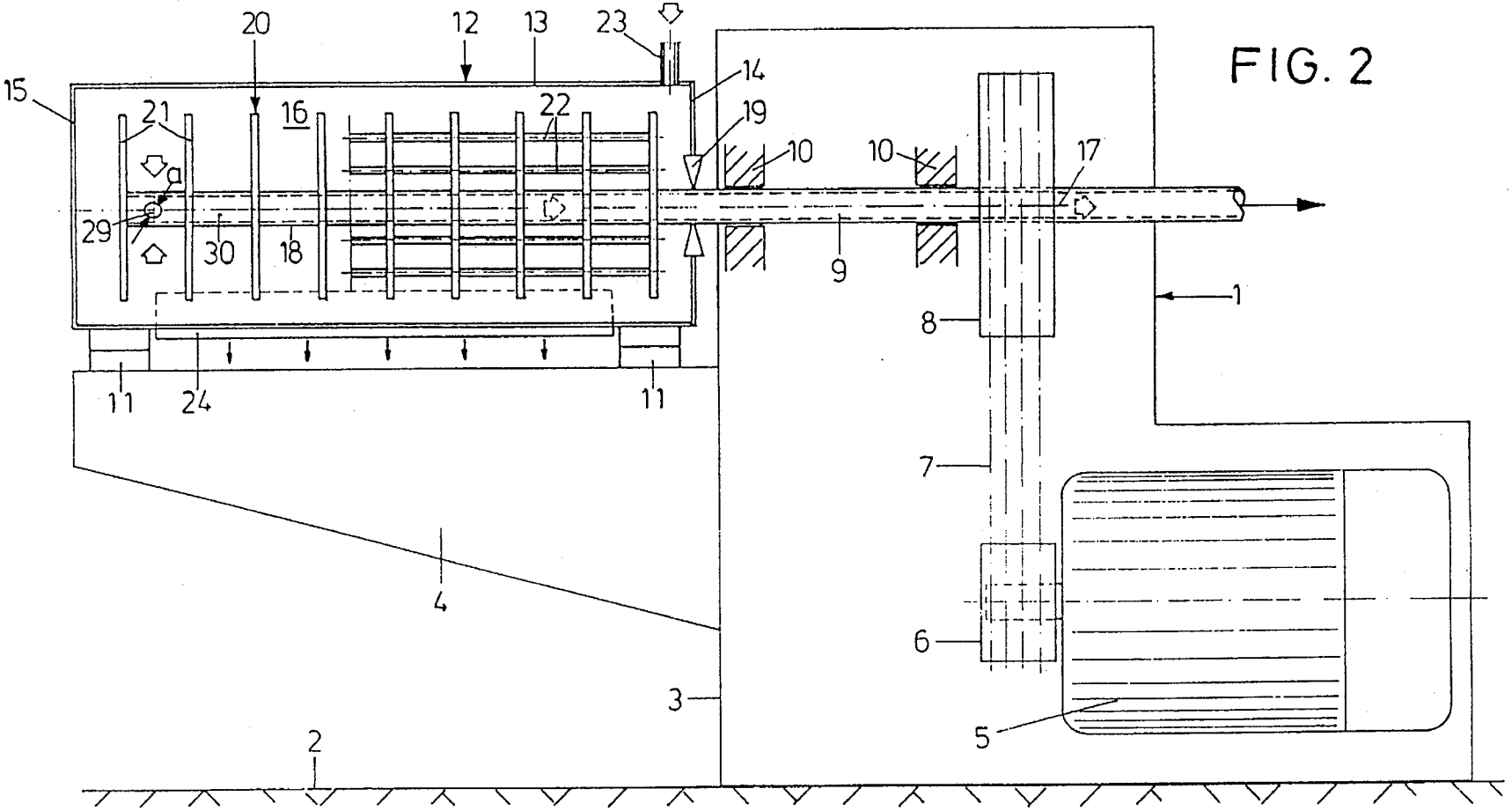
FIG. 2 is a diagrammatic illustration of a vertical section of a second embodiment of an autogenous-grinding apparatus composed in the way of an agitator mill.
Figure 3:
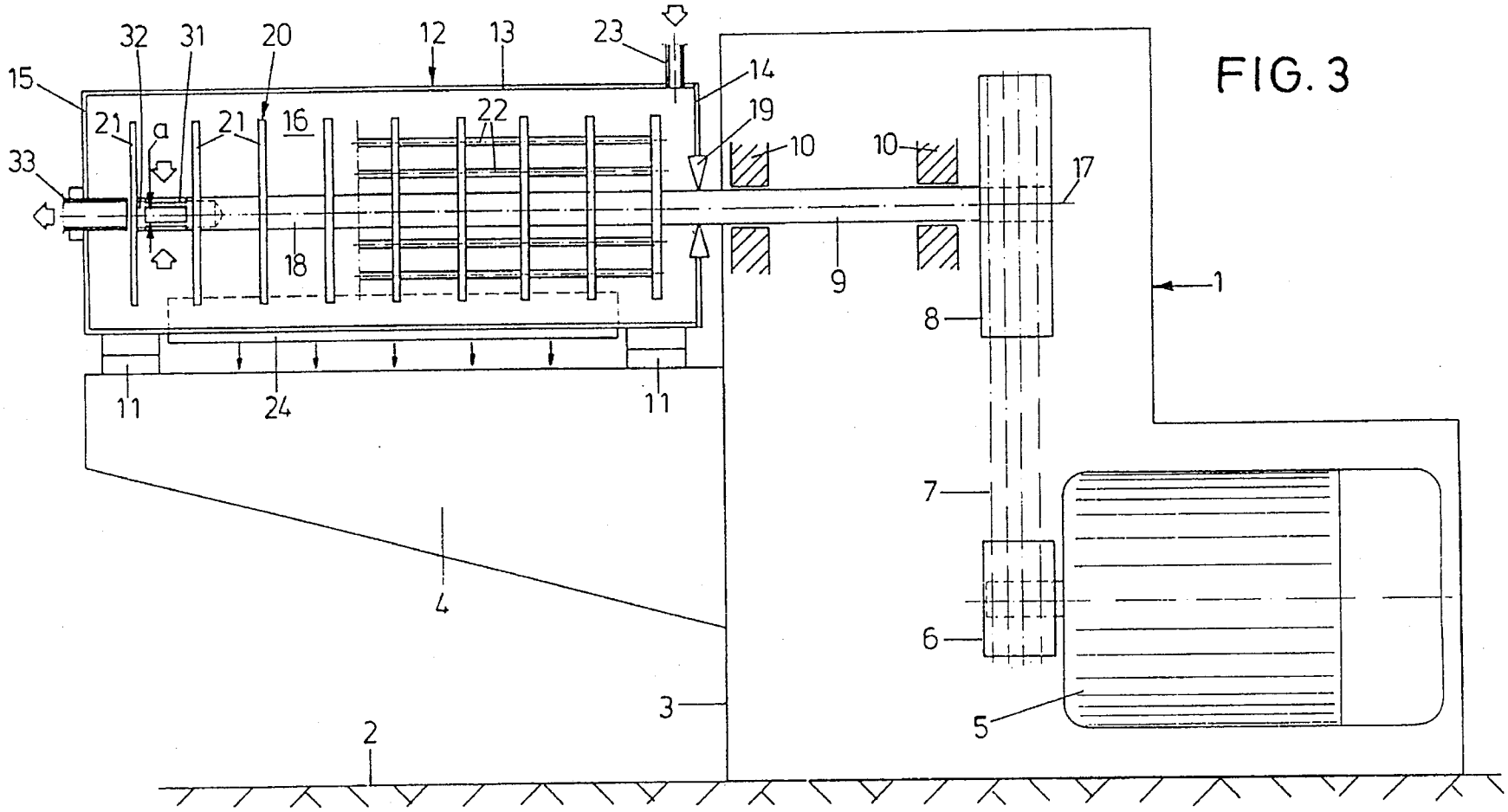
FIG. 3 is a diagrammatic illustration of a vertical section of a third embodiment of an autogenous-grinding apparatus composed in the way of an agitator mill.

Fundamentally, the embodiments according to FIGS. 1 to 3 are so-called horizontal agitator mills conventionally provided with a stand 1, which is supported on the ground 2. A support arm 4 is attached to the face 3 of the stand 1.

The stand houses a drive motor 5 speed-variable, if required, which is provided with a V-belt pulley 6, by means of which a drive shaft 9 can be driven for rotation by way of a V-belt 7 and another V-belt pulley 8. The drive shaft 9 is rotatably run in several bearings 10 on the stand 1.

A substantially cylindrical grinding receptacle 12 is supported on the support arm 4 in corresponding retainers 11. The grinding receptacle 12 has a cylindrical wall 13, its end facing the stand 1 being closed by a lid 14 and the opposite end by a bottom 15. It encloses a grinding chamber 10.

An agitator shaft 18 passing through the lid 14 is disposed in the grinding chamber 16 concentrically of the common central longitudinal axis 17 of the grinding receptacle 12. The grinding chamber 16 is sealed by seals 19 between the lid 14 and the shaft 18. The shaft 18 is cantilevered, i.e. it is not run in bearings in the vicinity of the bottom 15. Along its length within the grinding chamber 16, it is provided with agitator elements 20, which are agitator disks 21 in the present case. As seen on the right in FIG. 1, these agitator disks 21 can additionally be provided with agitator rods 22, which extend parallel to the axis 17 and are disposed in the form of a cage and by means of which the centrifugal forces are increased.

A supply connector 23, through which stock to be treated is supplied, is attached to the grinding receptacle 12 in vicinity to the lid 14. The lower side of the wall 13 of the grinding receptacle 12 is provided with a discharge flap 24 extending along a substantial part of the length of the grinding receptacle 12 between the retainers 11.

In all the embodiments, the grinding receptacle 12 is provided with an outlet of varying design for the different embodiments. All the outlets have in common that an auxiliary-grinding-body retaining device as it is customary in agitator mills does not exist. Such auxiliary-grinding-body retaining devices are screens in a plurality of types or so-called gap separator devices as specified for instance by British patent 1 056 257.

In the embodiment according to FIG. 1, an outlet pipe 25 is disposed in the bottom 15 coaxially to the axis 17, having an opening 26 on its face. This outlet pipe 25 extends as far as into the proximity of the agitator shaft 18, i.e. into the proximity of the agitator disk 21 on the end of the shaft 18. This agitator disk 21 on the end is provided with a short pipe section 27 for instance in the shape of a truncated cone open towards the bottom 15 and leaving a passage 28 towards the bottom 15. The outlet pipe 25 and the pipe section 27 overlap in the direction of the axis 17.

In the embodiment according to FIG. 2, the agitator shaft 18 is provided with outlet apertures 29 in vicinity to its free end, and that between the two last agitator disks 21, the outlet apertures 29 opening into a discharge conduit 30 inside the hollow agitator shaft 18. The discharge conduit 30 discharges from the agitator shaft 18 in the vicinity of the latter's end located outside the grinding receptacle 12. For increasing the centrifugal effect, the agitator rods 22 mentioned can be provided in the vicinity of the aperture 29.

In the embodiment according to FIG. 3, the agitator shaft 18 is provided with outlet apertures 31 in the vicinity of its free end and, in this case too, between the two last adjacent agitator disks 21, the outlet apertures 31 opening into a discharge conduit 32 that is open towards the free end of the agitator shaft 18. This discharge conduit 32 again opens into an outlet pipe 33, disposed in the bottom 15, the front of the outlet pipe 33 leaving as narrow as possible a gap towards the free end of the agitator shaft 18.

Figure 4:
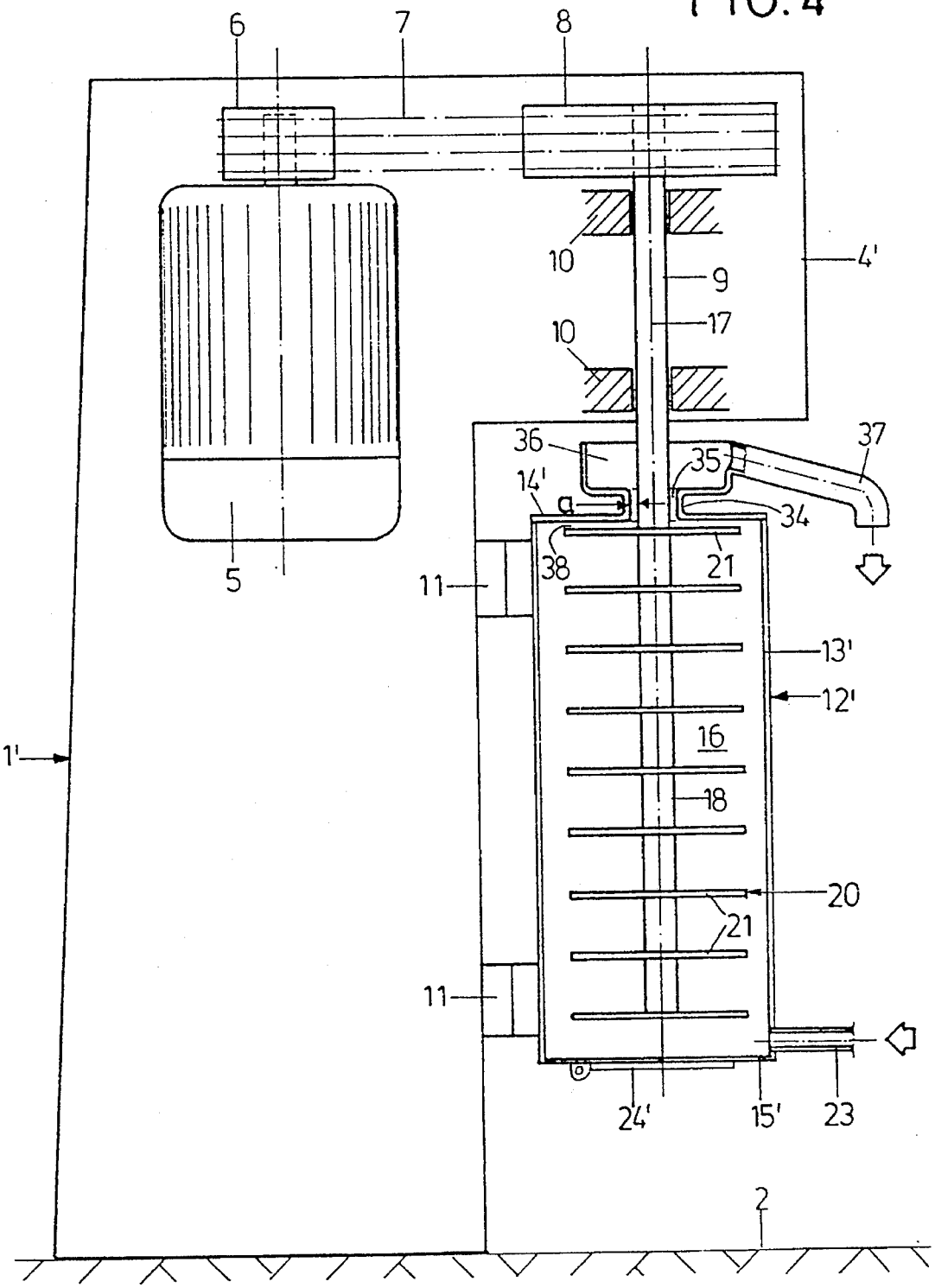
FIG. 4 is a diagrammatic illustration of a vertical section of a fourth embodiment of an autogenous-grinding apparatus composed in the way of an agitator mill.

The embodiment according to FIG. 4 is a vertical agitator mill. To the extent the components are identical, the same reference numerals are used as with FIGS. 1 to 3, parts that differ in construction, but are identical functionally, have the same reference numerals as in the embodiments according to FIGS. 1 to 3, however provided with a prime. In this case, the supply connector 23 is provided in the vicinity of the lower bottom 15', which comprises a discharge flap 24'. The outlet is accommodated in the lid 14', there being neither need nor provision for a seal towards the agitator shaft 18. The outlet is formed by an outlet connector 34 encircling the agitator shaft 18 and defining an annular outlet passage between itself and the shaft 18. This outlet passage 35 opens into an outlet cup 36 located above the lid 14' and from which discharges a discharge line 37.

The agitator disk 21 adjacent to the lid 14' is disposed to leave only a very narrow outlet gap 38 towards the lid 14' so that high centrifugal forces are generated in particular in the outlet gap 38.

Figure 5:
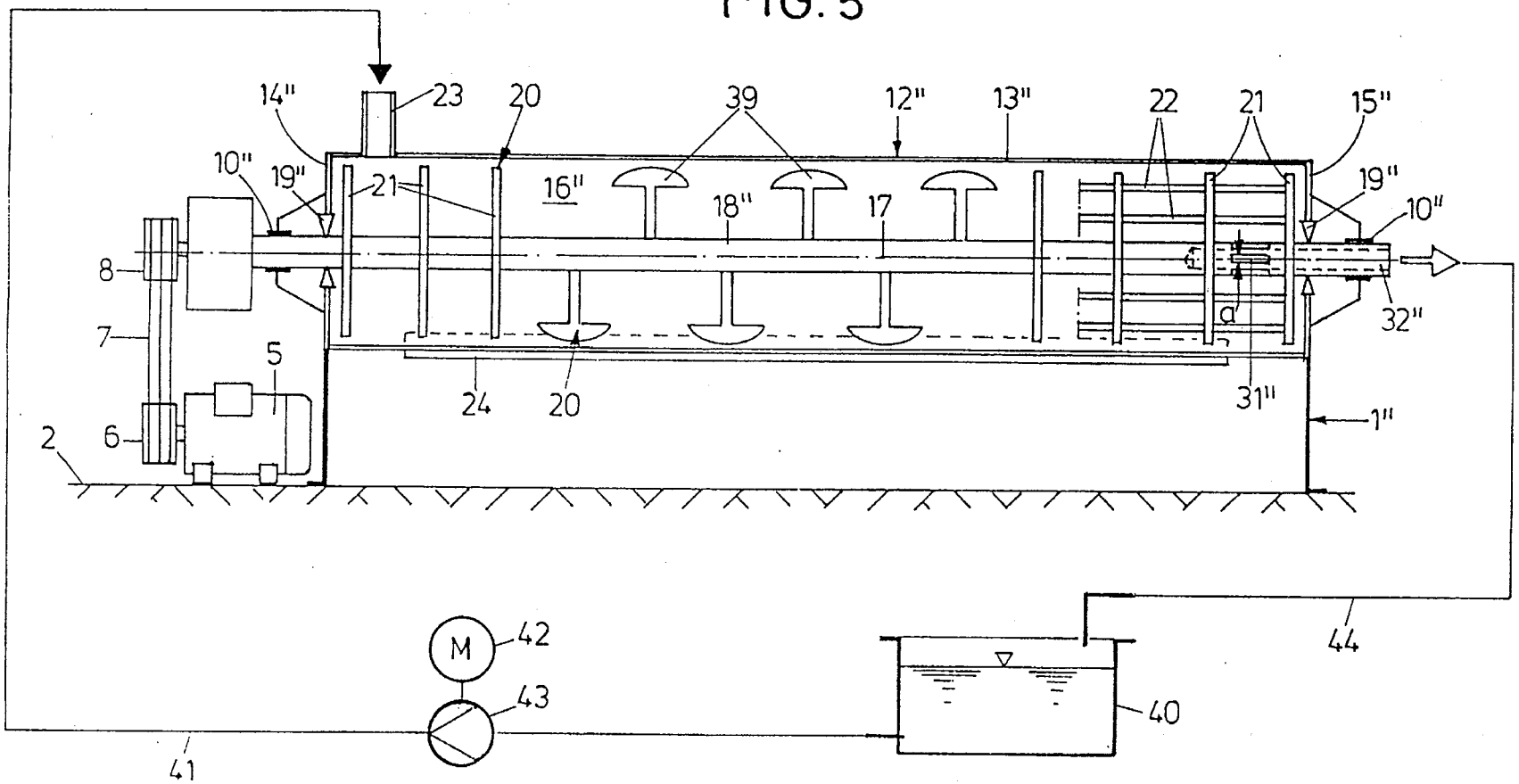
FIG. 5 is a diagrammatic illustration of a vertical section of a fifth embodiment of an autogenous-grinding apparatus composed in the way of a ring mixer.

While the embodiments according to FIGS. 1 to 4 are agitator mills, the embodiment according to FIG. 5 is structured in the way of a high-speed mixer. Components that are functionally identical with the embodiments according to FIGS. 1 to 3 have the same reference numerals, however provided with a double prime. A renewed description is not necessary in this regard.

On the one hand, the agitator shaft 18" is run in a bearing 10" in the vicinity of the lid 14" and on the other hand, it is run in a bearing 10" in the vicinity of the bottom 15", i.e. it is not cantilevered, but both its ends run in bearings. Seals 19" are provided where the agitator shaft 18" passes through the lid 14" and the bottom 15". The agitator shaft 18" is provided with agitator elements 20, which may again be agitator disks 21; the agitator elements 20 may, however, also be con ventional blade-type mixing elements 39, as likewise illustrated in FIG. 5.

A supply connector 23 is provided in vicinity to the lid 14", opening into the grinding chamber 16". Outlet apertures 31" are provided in vicinity to the bottom 15", namely between the two last agitator disks 21; the outlet apertures 31" open into a discharge conduit 32" formed in the agitator mill, the discharge conduit 32" again discharging downstream of the bearing 10" on the side of the lid. Of course, the specified agitator rods 22 can be provided in this case, too.

Only FIG. 5 roughly outlines that the stock is repeatedly supplied to the treating process. To this end, a reservoir 40 is provided, which is connected with the supply connector 23 via a supply line 41. A pump 43 driven by a motor 42 and serving for the transport of the stock is connected in this supply line 41. The discharge conduit 32" is in turn connected with the reservoir 40 via a return line 44.

Figure 6:
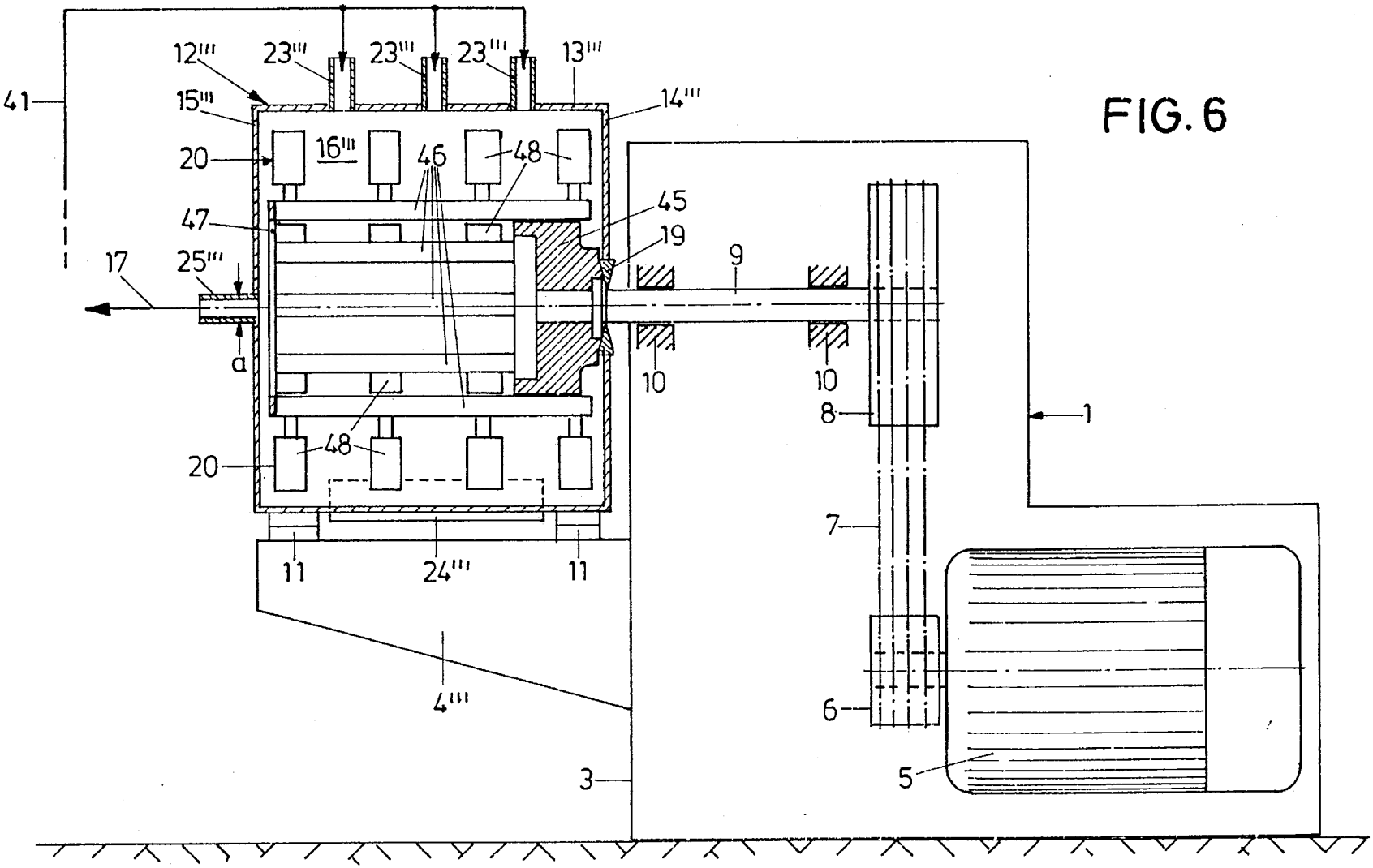
FIG. 6 is a diagrammatic illustration of a vertical section of a sixth embodiment of an autogenous-grinding apparatus composed in the way of an agitator mill.

In the embodiment according to FIG. 6, the grinding receptacle 12''' has several supply connectors 23''' distributed along its length between the lid 14''' and the bottom 15''' and fed by a common supply line 41. An outlet pipe 25''' discharges from the bottom 15''', extending concentrically of the central longitudinal axis 17. The drive shaft 9 is provided with a cup-shaped agitator unit formed by a rotor disk 45 mounted on the drive shaft 9 and to which rods 46 are attached, which are parallel to, and concentric of, the central longitudinal axis 17 and which extend substantially along the length of the grinding receptacle 12''', the ends of the rods 46 located in vicinity to the bottom 15'' being joined by a link ring 47 for reinforcement. Consequently, the rotor disk 45 together with the rods 46 forms a kind of a cage. Blades or paddles 48 serving as agitator elements 20 are mounted on the rods 46 and extend as far as into the proximity of the wall 13'' of the grinding receptacle 12'''. The grinding elements 20 only cover the radially outer portion of the grinding chamber 16'''. To the extent components are identical, the same reference numerals are used in FIG. 6 as in the preceding figures. If some parts are identical in function, but differ in construction, they have the same reference numeral, however provided with a triple prime.

The apparatuses specified of continuous operation are among other things used for the grinding of especially hard stock; this may for instance be silicates or carbides. But they are also used for the grinding of lowgrade bulk goods such as calcium carbonate, sand ($SiO_2$), mineral substances and in particular ores. The stock is made free-flowing with the aid of water or some other suitable fluid and supplied via the supply connector 23 or the supply connectors 23''' to the grinding receptacle 12 or 12' or 12'' or 12''' and intensively stirred by the rotating high-speed agitator elements 20. At the beginning of a grinding operation, particles of greater diameter are fed to the respective grinding chamber 16, 16' or 16'''. Now two categories can be differentiated. In a first case, coarse particles are supplied along with a fluid at the beginning of the grinding operation and then fine particles are added continuously, which are comminuted. When the coarse particles are abraded partially, they must be refilled. In the other case, coarse particles and fine particles are added right from the start, the coarse particles being concentrated in the grinding chamber.

The coarse particles, i.e. the particles of greater diameter, have a size of 0.1 to 5.0 mm, usually ranging from 1.0 to 2.0 mm. The lower limit of their diameter ranges from 0.1 to 0.3 mm, the usual upper limit from 3.0 to 4.0 mm. The fine particles, i.e. the particles of smaller diameter of the grinding stock, should be smaller than the particles of greater diameter used as a kind of auxiliary grinding bodies by the factor 0.3 to 0.05. The grinding receptacles 12 or 12' or 12'' or 12''', respectively, are completely filled with the stock. The particles of greater diameter contained in the stock are increasingly catapulted into the outer portion, i.e. in a direction towards the wall 13 or 13'' of the grinding receptacle 12, 12', 12'' or 12''', i.e. they are concentrated in the grinding chamber 16, 16''. The particles of greater diameter take part in the grinding process, working as a sort of auxiliary grinding bodies to grind the smaller particles, while being abraded themselves until the desired particle size distribution is attained. Since the stock discharges from the grinding chamber 16, 16'', 16''' in the vicinity of the axis 17 and, respectively, of the shaft 18 or 18'' via the specified outlets 25, 29, 31, 1'', 34, 25''', these greater particles will at least predominantly stay in the grinding chamber 16, 16'', 16'''. If the stock is repeatedly guided through the grinding chamber 16 or 16'' or 16''', respectively, the greater particles will eventually be pulverized at least partially. In as much as particles of greater diameter are discharged along with the treated grinding stock, they cannot obstruct a retaining device, because there is no such device. All the outlets have a minimum width a, which clearly exceeds the particles of greater diameter. The minimum width of an outlet is at least 5 mm, as a rule at least 10 min. When, in the case of circulatory grinding, the stock located in the reservoir 40 has been ground to exhibit a given particle size distribution, then the batch located in the reservoir 40 can be exchanged, the quantity of stock in the grinding chamber 16 or 16'' or 16''' not being exchanged, because it still contains a higher number of particles of greater diameter. These measures for the repeated circulation of stock through the grinding chamber 16 or 16'' or 16''' can in like manner be applied to all the other embodiments.

For a strong concentration of particles of greater diameter to take place in the grinding chamber, the speed of the agitator unit on the one hand and the throughput of grinding stock on the other must be tuned optimally. To this end, the power draw of the drive motor 5 or 5'', respectively, or the latter's current consumption may serve as a characteristic number. It is the fundamental object of any control to achieve a maximum of power draw. This is again ensured by a high concentration of particles of great diameter in the grinding chamber. If the power draw decreases with an increase of the throughput, it is to be concluded that the number of particles of greater diameter has decreased in the grinding chamber 16 and 16'' and 16''', either due to abrasion or due to discharge. In this case, stock consisting of particles of greater diameter must be added. If the power draw increases again, the problem is solved. If this is not the case, then particles of greater diameter are discharged noticeably; in this case, either the throughput of stock must be reduced or - if a speed-variable drive motor 5 is available - the speed of the agitator shaft 18, 18'' must be increased.

Figure 7:
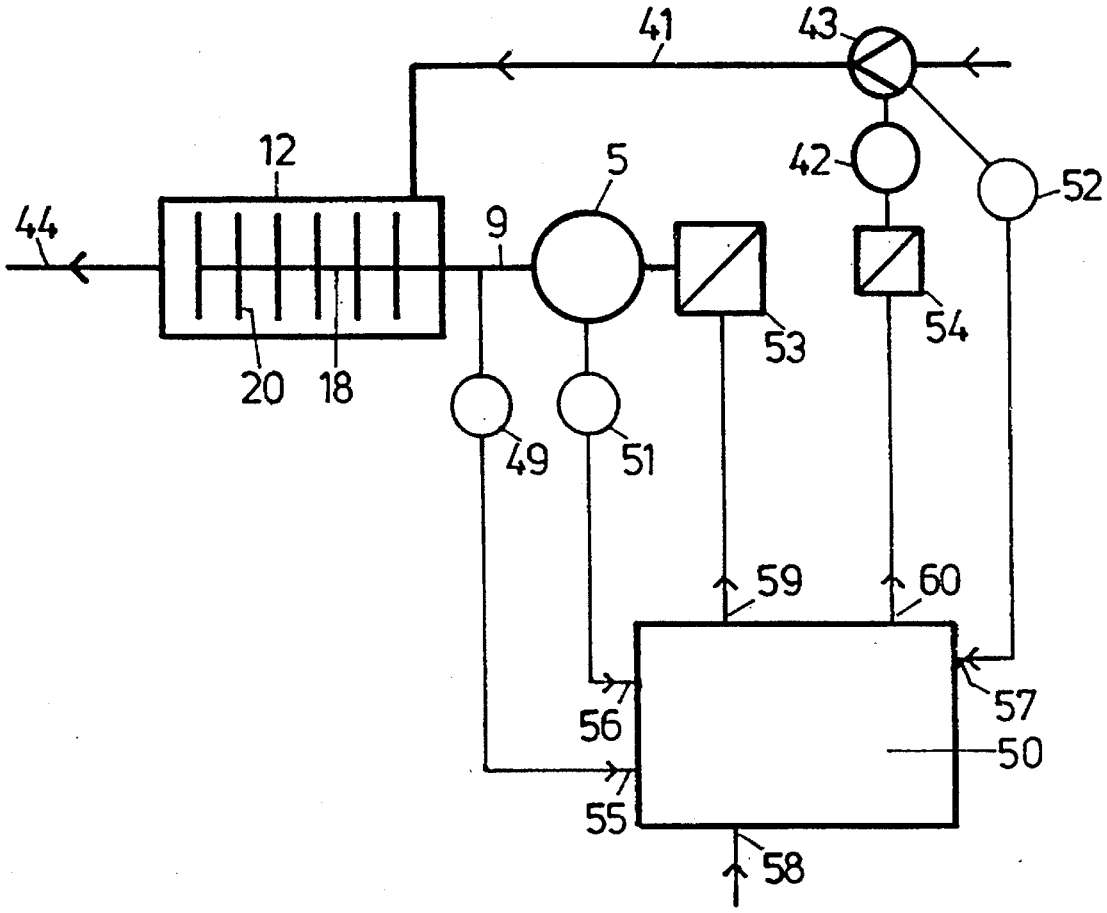
FIG. 7 is a control block diagram for an agitator mill.

In practice, the control can be performed in the way illustrated in FIG. 7. A speed detection unit 49 is connected with the drive shaft 9 and thus with the agitator shaft 18, passing a signal that corresponds to the speed to the control unit 50. Further, the power draw of the drive motor 5 is taken by means of a power detection unit 51 and passed to the control unit 50. Furthermore, a throughput detection unit is assigned to the pump 43, passing a signal that corresponds to the throughput per unit of time to the control unit 50. The throughput detection unit 52 may be a tachometer, the speed being a measure of the throughput in pumps working free from slip or at a constant slip. A speed control unit 53 is further assigned to the drive motor 5, which may for instance be a frequency converter. In like manner, a speed control unit 54 is assigned to the drive motor 42 of the pump 43, which may also be a frequency converter. The speed of the drive shaft 9, the power draw of the drive motor 5 and the throughput of the pump 43 are fed as inputs 55, 56, 57 into the control unit 50. A desired value of power draw is fed into the control unit 50 via an input 58. In accordance with the control scheme specified above, the speed control unit 53 of the drive motor 5 and the speed control unit of the motor 41 of the pump 43 are triggered via outputs 59, 60 by the control unit 50. In the first case, the speed of the agitator unit is changed; in the second case, the throughput of the pump 43 is changed.

What is claimed is:

1. A method for the continuous autogenus grinding of free-flowing stock containing insoluble particles of varying diameter, wherein the stock is supplied to a grinding chamber (16, 16'', 16''') and is set rotating concentrically of a central longitudinal axis (17) in said grinding chamber (16, 16''', 16''') which has a first end and a second end, wherein insoluble particles of greater diameter are concentrated in the grinding chamber (16, 16", 16'") superportionally as compared to particles of smaller diameter and wherein the stock is discharged from the grinding chamber (16,16 '",6'") at one of the first end and second end in the vicinity Of the central longitudinal axis (17) through an outlet opening, which has a substantially larger size than the particles of larger diameter.

2. A method according to claim 1, wherein the particles of smaller diameter are smaller than the particles of greater diameter by the factor 0.3 to 0.05.

3. A method according to claim 1, wherein predominantly particles of greater diameter are supplied to the grinding chamber (16, 16", 16'") at the beginning of a grinding operation, particles of smaller diameter being predominantly supplied during the ensuing grinding operation.

4. A method according to claim 1, wherein - referred to the central longitudinal axis (17) - stock is supplied to the first end of the grinding chamber (16, 16") and is discharged from the grinding chamber (16, 16") at the second end in the vicinity of the central longitudinal axis (17).

5. A method according to claim 1, wherein - referred to the central longitudinal axis (17) - stock is supplied along the length of the grinding chamber (16'").

6. A method according to claim 1, wherein the stock is repeatedly run through the grinding chamber (16, 16').

7. A method according to claim 1, wherein for the discharge of inorganic particles of at least one of higher density and greater diameter from the grinding chamber (16, 16", 16'"), there is at least one of a reduction of the supply of stock to the grinding chamber (16, 16", 16'") and and increase of the rotating.

8. An apparatus for putting into practice the method for the continuous autogenous grinding of free-flowing stock containing insoluble particles of varying diameter, wherein the stock is set rotating concentrically of a central longitudinal axis (17) in a grinding chamber (16, 16", 16'") which has a first end and a second end, and wherein insoluble particles of greater diameter are concentrated in the grinding chamber (16, 16", 16'") superproportionally as compared to particles of smaller diameter, comprising a grinding receptacle (12, 12', 12", 12'") with a wall (13, 13', 13", 13'") enclosing a grinding chamber (16, 16", 16'") and with a central longitudinal axis (17) and free from auxiliary grinding bodies, an agitator unit disposed in the grinding receptacle (12, 12', 12", 12'") concentrically of the central longitudinal axis (17), agitator elements (20) attached to the agitator unit, a drive motor (5, 5") coupled with the agitator unit, at least one stock supply connector (23, 23'") opening into the grinding chamber (16, 16", 16'"), and at least one outlet for treated stock disposed in the vicinity of the central longitudinal axis (17) and not comprising an auxiliary-grinding-body retaining device.

9. An apparatus according to claim 8, wherein the agitator unit has a cantilevered agitator shaft (18) with a face and wherein the outlet is an outlet pipe (25) disposed concentrically of the cantilevered agitator shaft (18) and opens towards said face.

10. An apparatus according to claim 9, wherein in the direction of the central longitudinal axis (17), the outlet pipe (25) is at least partially covered by a pipe section (27) connected with the agitator shaft (18).

11. An apparatus according to claim 10, wherein a passage (28) is formed in at least one of a location between the pipe section (27) and an adjacent bottom (15) of the grinding receptacle (12) and a location between the outlet pipe (25) and the agitator shaft (18).

12. An apparatus according to claim 8, wherein the agitator unit has an agitator shaft (18, 18") and wherein the outlet is formed by at least one outlet aperture (29, 31, 31") provided in the agitator shaft (18, 18") and opening into a discharge conduit (30, 32, 32") located in the agitator shaft ( 18, 18").

13. An apparatus according to claim 12, wherein - referred to the central longitudinal axis (17) - at least one agitator element (20) is mounted on the agitator shaft (18, 18") on either side of the at least one outlet aperture (29, 31, 31").

14. An apparatus according to claim 8, wherein the agitator unit has an agitator shaft (18) and wherein the outlet is an annular outlet passage (35) encircling an agitator shaft (18).

15. An apparatus according to claim 13, wherein the outlet passage (35) is defined by an outlet connector (34) provided in a lid (14') of the grinding receptacle (12') and forming a passage for the agitator shaft (18).

16. An apparatus according to claim 8, wherein at least one agitator element (20) is provided in direct vicinity to an outlet.

17. An apparatus according to claim 8, wherein the agitator elements (20) are agitator disks (21).

18. An apparatus according to claim 8, wherein agitator rods (22) disposed in the way of a cage approximately parallel to the central longitudinal axis (17) are provided on the agitator elements (20).

19. An apparatus according to claim 8, wherein the grinding receptacle (12, 12"; 12'") is approximately horizontal.

20. An apparatus according to claim 8, wherein the grinding receptacle (12') is substantially vertical and wherein the at least one supply connector (23) opens into the lower portion of the grinding receptacle (12') and wherein the outlet is provided in an upper portion of the grinding receptacle (12').

21. An apparatus according to claim 8, wherein the agitator unit is provided with rods (46) in the way of a cup-shaped cage, which extend parallel and concentrically of the central longitudinal axis (17) and to which agitator elements (20) are attached in the way of at least one of blades and paddles (48).

22. An apparatus according to claim 8, wherein several supply connectors (23'") open into the grinding chamber (16'"), which are disposed on the wall (13") of the grinding receptacle (12") in a manner distributed along the wall (13'").

23. An apparatus according to claim 8, wherein the at least one outlet for treated stock has a minimum width (a) of at least 5 min.

24. An apparatus according to claim 23, wherein the at least one outlet for treated stock has a minimum width (a) of at least 10 mm.

25. An apparatus according to claim 8, wherein a control unit (50) is provided for at least one of an increase of speed of the agitator unit and a reduction of supply of stock upon decrease of power draw of the drive motor (5, 5").

* * * * *

UNITED STATES PATENT AND TRADEMARK OFFICE

CERTIFICATE OF CORRECTION

PATENT NO. : 5,570,846

DATED : November 5, 1996

INVENTOR(S) : Stehr

It is certified that error appears in the above-indentified patent and that said Letters Patent is hereby corrected as shown below:

On the title page, item [22], insert the following:

foreign application priority data:

--[30] Foreign Application Priority Data
Sep. 9, 1994 [DE] Germany P4432153.8--

Signed and Sealed this

Eleventh Day of February, 1997

*Attest:*

BRUCE LEHMAN

*Attesting Officer*

*Commissioner of Patents and Trademarks*